US005465441A

United States Patent [19]

Chun

[11] Patent Number: 5,465,441

[45] Date of Patent: Nov. 14, 1995

[54] SLIDEABLE SEATING MEMBER

[76] Inventor: Bongsoo Chun, 70 Cass Avenue, Unit #93, Scarborough, Ontario, Canada, M1T 3P9

[21] Appl. No.: 279,351

[22] Filed: Jul. 25, 1994

[51] Int. Cl.[6] ..... A47C 27/00

[52] U.S. Cl. ..... 5/653; 5/925; 5/926

[58] Field of Search ..... 5/925, 926, 653, 5/448

[56] References Cited

U.S. PATENT DOCUMENTS

| | | | |
|---|---|---|---|
| 3,205,514 | 9/1965 | Reynolds | 5/496 |
| 3,829,914 | 8/1974 | Treat | 5/925 |
| 3,849,813 | 11/1974 | Neilson | 5/925 |
| 4,164,798 | 8/1979 | Weber | 5/925 |
| 4,319,781 | 3/1982 | Tsuge | 5/925 |
| 4,457,032 | 7/1984 | Clarke | 5/481 |
| 5,123,113 | 6/1992 | Smith | 5/926 |

FOREIGN PATENT DOCUMENTS

| | | | |
|---|---|---|---|
| 04614 | 8/1987 | WIPO | 5/925 |

*Primary Examiner*—Michael J. Milano

[57] ABSTRACT

A seating member grips to the clothing of a user on the seating member and slides on a support surface for the seating member. The seating member has a low co-efficient of friction bottom surface, and a high co-efficient of friction top surface. The top and bottom surfaces are coupled to one another to resist rotation between the two of them.

4 Claims, 1 Drawing Sheet

FIG.1.
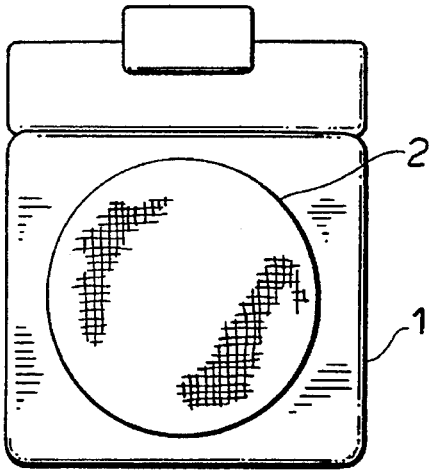
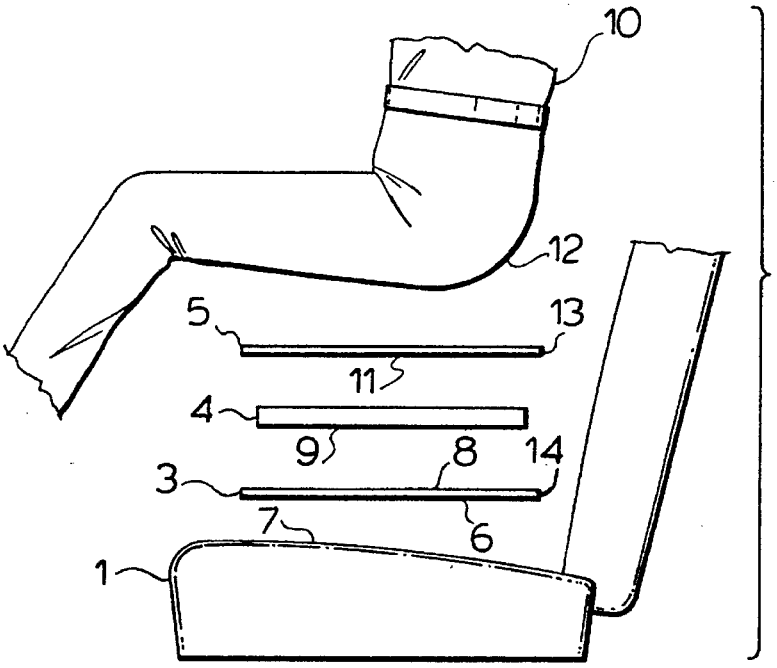
FIG.2.
FIG.3.
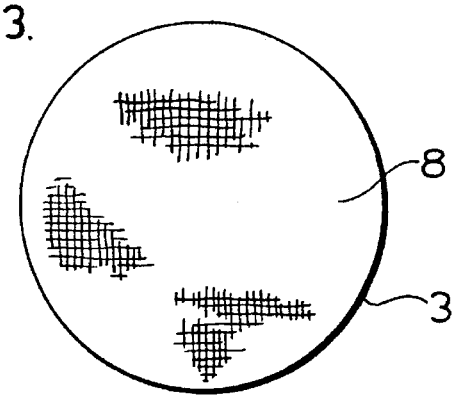

SLIDEABLE SEATING MEMBER

FIELD OF THE INVENTION

The present invention relates to a seating member which is specifically designed to easily move on a supporting surface without sliding beneath the user of the seating member. The seating member is especially useful in a motor vehicle.

BACKGROUND OF THE INVENTION

A typical passenger motor vehicle has forward facing seats and side facing doors. This arrangement makes it difficult for drivers and passengers to enter into and exit from such vehicles and often requires one to both push and turn the upper and lower body with one's buttocks in full contact with the seat's abrasive covering material. The abrasive contact often results in premature wear of one's garment at the area of the buttocks. In addition, the uncoordinated body maneuver promotes a bad body posture which in turn may cause various back ailments. It has been proposed to provide seats with a swivel mechanism to overcome the above drawbacks. However, seats of this type are not readily available because they need a complicated and rugged swivel and associated securing system to satisfy the current safety requirements. In addition, their construction requires a high manufacturing cost. Furthermore, in many instances, such swivel seats are not practical due to the tight interior space associated with motor vehicles.

SUMMARY OF THE INVENTION

The present invention provides a seating member specifically designed to overcome the drawbacks described above. In particular, the seating member of the present invention has a bottom surface with a low co-efficient of friction which makes it readily slideable for turning maneuvers and the like on the support surface for the seating member. In addition, the seating member has a high co-efficient of friction top surface such that it grips to the clothing of a user for the seating member. The top and bottom surfaces are coupled to one another in a manner to resist rotation between them.

BRIEF DESCRIPTION OF THE DRAWINGS

The above as well as other advantages and features of the present invention will be described in greater detail according to the preferred embodiments of the present invention in which;

FIG. 1 is a plan view of a seating member in accordance with a preferred embodiment of the present invention and placed on the seat cushion of a typical automobile seat;

FIG. 2 is an exploded side view of the seating member of FIG. 1 in position for use on a vehicle seat;

FIG. 3 is a top perspective view of the bottom element from the seating member shown in FIG. 2.

DETAILED DESCRIPTION ACCORDING TO THE PREFERRED EMBODIMENTS OF THE PRESENT INVENTION

As best seen in FIG. 2 of the drawings, a seating member 2 comprises three generally circular flexible elements including a bottom 3, a middle 4 and a top 5. The bottom surface 6 of the bottom element 3 functions as a bearing surface while this element is in direct contact with its supporting surface and in this particular case the covering material 7 of the automobile seat. The bottom surface 6 of element 3 specifically has a surface with a very low co-efficient of friction so that it will easily slide on the seat covering material 7. In contrast, the top surface 8 of the bottom element 3 functions as a friction and reinforcing surface as it is rubbed against the bottom surface 9 of the middle element 4. There is a high co-efficient of friction between surfaces 8 and 9 which resists any turning or rotation between the bottom element and the middle element.

Middle element 4 is made from a material such as a soft foam or the like so that it is soft and flexible to conform to the contour of the seat surface and to transmit the seat's cushioning characteristic to the occupant 10 of the vehicle. In addition, the middle element because of it's foam construction has its own cushioning effect. The material chosen for the middle element should be one that resists torsional distortion to avoid wrinkling between the middle element and the bottom element which would otherwise detract from the sliding characteristics provided on the undersurface of the seating member.

Many different materials or combinations of materials may be used to form the bottom element 3 with its required surface characteristics. For example, bottom element 3 may be made from a vinyl sheet with a smooth undersurface and a roughened upper surface. FIG. 3 shows one embodiment of the invention in which bottom element 3 is made from plastic fibers which are woven at right angles to one another where the weave is exposed at the upper surface of the bottom element and providing a very positive grip on the undersurface of the middle element. The undersurface of the bottom element, on the other hand, has a much smoother surface so as to make it in effect very slippery relative to any surface on which it is supported.

As a further alternative, the bottom element may be made from a vinyl sheet with a smooth undersurface and with reinforcing grip strips or the like laminated to the upper surface of the bottom element. In addition, a thin sheet of torsionally resistant grip material can be placed between the bottom and middle elements to resist wrinkling of the seat.

In both of the above examples, the bottom element is constructed such that it resists horizontal distortion but still bends vertically so as not to detract from the cushioning provided by the seating member.

The top element 5 is made from a material such as a rough fabric or the like which has a high grip on both its upper and lower surface. The high grip or high co-efficient of friction on the upper surface of the top element 5 provides a frictional interlock between the seat member and the occupant's garment 12 when the seating member 2 is beneath the occupant. The high grip lower surface of the top element provides a frictional interlock between it and the middle element 4.

The material used in forming the top element 5 may be the same type of durable fabric material used in many of todays automotive seats.

From the description above of the construction of seating member 2, it is easily understood how the seating member operates. The occupant sits on the upper surface of the seating member which grips on the occupant's garment. However, the undersurface of the seating member with its low co-efficient of friction provides a bearing surface which slips or slides on the upper surface of the seat itself. This allows a simple and easy rotation by the occupant while sitting on the seating member which moves with the occupant relative to the seat between, for example, a sideways facing position and a forward facing position to enter and exit the vehicle.

In order to further stabilize the seating member, the perimeter or outer edge 14 of the bottom element may be positively secured as for example by stitching or zippers to the outer edge 13 of the top element to completely prevent slipage between the top and bottom elements. The use of zippers has the added benefit that they can easily be released for cleaning and/or replacing the elements within the seating member.

The description above relates to the seating member as it is used in an automobile. It is however to be understood that the seating member can also be used in many other situations where one wants to have a swivel or sliding seat without the requirement of high cost mechanisms for operation of the seat.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A seating member which grips to a user and which slides on a support surface of the seating member, said seating member being made from a top element having a height co-efficient of friction top surface, a bottom element and a middle cushion between said top element and said bottom element, said bottom element comprising a layer of plastic material having a smooth bottom side and a textured upper side in engagement with and gripping on said middle cushion, and said top and bottom elements being coupled to resist rotation therebetween.

2. A seating member as claimed in claim 1, wherein said cushion is made of foam, having a high co-efficient of friction which grips both said top element and said bottom element.

3. A seating member as claimed in claim 1, wherein said layer of plastic is reinforced by regions of material that cross one another on said bottom element and which resist horizontal distortion while allowing vertical bending of said bottom element.

4. A seating member as claimed in claim 1, wherein said layer of plastic is formed by separate strands of plastic material woven at right angles to one another through said layer of plastic.

* * * * *